US012292257B1

(12) United States Patent
Tucker

(10) Patent No.: US 12,292,257 B1
(45) Date of Patent: May 6, 2025

(54) HOLSTER COVER DEVICE

(71) Applicant: John Martin Tucker, Williamston, NC (US)

(72) Inventor: John Martin Tucker, Williamston, NC (US)

( * ) Notice: Subject to any disclaimer, the term of this patent is extended or adjusted under 35 U.S.C. 154(b) by 109 days.

(21) Appl. No.: 17/947,990

(22) Filed: Sep. 19, 2022

Related U.S. Application Data

(60) Provisional application No. 63/247,495, filed on Sep. 23, 2021.

(51) Int. Cl.
*F41C 33/04* (2006.01)
*F41C 33/02* (2006.01)

(52) U.S. Cl.
CPC ..... *F41C 33/046* (2013.01); *F41C 33/0209* (2013.01)

(58) Field of Classification Search
CPC .... F41C 33/008; F41C 33/02; F41C 33/0209; F41C 33/0218; F41C 33/0227; F41C 33/0254; F41C 33/04; F41C 33/041; F41C 33/046; F41C 33/048; Y10S 224/904; Y10S 224/907; Y10S 224/911
USPC ..... 224/243
See application file for complete search history.

(56) References Cited

U.S. PATENT DOCUMENTS 2,832,519 A * 4/1958 Ojala ..... F41C 33/0227 224/222
4,898,310 A * 2/1990 Remington ..... F41C 33/046 224/198
5,170,919 A * 12/1992 DeSantis ..... F41C 33/048 224/931
11,490,718 B2 * 11/2022 Lederle ..... A45F 5/00

* cited by examiner

*Primary Examiner* — Derek J Battisti
*Assistant Examiner* — Matthew T Theis
(74) *Attorney, Agent, or Firm* — John Rizvi; John Rizvi, P.A.—The Patent Professor ®

(57) ABSTRACT

A holster cover device that is capable of covering a strap having a firearm holster secured thereto with a firearm therein. The device may include a sleeve component having an elongated body, an internal cavity extending through the body, and a pair of openings to the internal cavity at ends of the body, and a pocket component having a body with sides that define therebetween an internal compartment, an opening to the internal compartment at an end of the body, and connection members configured to releasably couple to ends of the sleeve component such that the sleeve component forms a closed loop. The internal cavity of the sleeve component is configured to receive the strap and the internal compartment of the pocket component is configured to receive the firearm holster while the firearm holster is secured to the strap and has the firearm therein.

17 Claims, 10 Drawing Sheets

HOLSTER COVER DEVICE

CROSS-REFERENCE TO RELATED APPLICATIONS

This application claims the benefit of U.S. Provisional Patent Application Ser. No. 63/247,495, filed on Sep. 23, 2021, which is incorporated herein in its entirety.

FIELD OF THE INVENTION

The present invention relates generally to firearm holsters and methods for securing firearms to a person, and more particularly, to a holster cover device that receives and covers a strap having a firearm holster secured thereto with a firearm therein in a manner that improves the comfort of the user and positioning of the firearm.

BACKGROUND OF THE INVENTION

Firearm holsters are generally formed of relatively stiff materials that are capable of supporting a firearm, generally a handgun (e.g., a pistol or a revolver), while not interfering with an action of drawing the firearm from the holster. Traditional materials often included leather, ballistic nylon, and more recently molded plastic materials. While many firearm holsters are commercially available that fit stock firearms, the firearm industry includes a large aftermarket for firearm customization and finding a firearm holster that fits a specific customized firearm may be a more difficult task.

Advances in various technologies and materials have led to an increased availability and reduced cost of custom firearm holsters. In addition, certain materials and methods are available that allow firearm owners to produce their own custom holsters. For example, custom holsters may be formed from thermoplastic sheets by creating a mold for the custom firearm, heating the thermoplastic sheets, and then vacuum molding the sheets in the mold to produce a custom fit, low profile molded plastic holster. Popular thermoplastic sheets often used for producing custom holsters include thermoplastic acrylic-polyvinyl chloride materials commercially available under the trademarks KYDEX®, HOLSTEX®, and BOLTARON®.

In addition to forming holsters fit to custom firearms, these technologies and materials have allowed for advances in methods of wearing the firearm holsters. For example, the molding process described above allows for minimization of the profile of the holsters. In addition, or as an alternative, systems and methods have been proposed for promoting concealment of the firearm and holster and improving functionality of the holster. For example, various holster concealment chassis are commercially available under the brand name Enigma™ from PHLster LLC. In general, these chassis include a strap (e.g., belt, harness, or similar device) that is secured to a firearm holster with an elongated faceplate which promotes concealment and proper positioning of the firearm holster and firearm therein. These holster concealment chassis may be configured to be worn under clothing directly against a user's skin and be independent from the clothing and/or other securing devices.

While the custom holsters and accessories described above provide significant benefits to gun owners, they often include various drawbacks. For example, surfaces and edges of the molded thermoplastic holsters and various metallic and plastic components of accessories such holster concealment chassis can be uncomfortable when in contact with a user's body. These devices and components are generally configured for functionality rather than comfort. Therefore, users often limit the time during which they wear such devices based on comfort rather than desire.

Accordingly, there is an established need for a device that could promote comfort of wearing firearm holsters.

SUMMARY OF THE INVENTION

The present invention is directed to a convenient and economical holster cover device that is capable of covering a strap having a firearm holster secured thereto and a firearm in the firearm holster in a manner that promotes comfort of the user by avoiding contact between the user and surfaces of the strap, the firearm holster, and, optionally, the firearm. The holster cover device may include a sleeve component having an elongated body, an internal cavity extending through the body, and a pair of openings to the internal cavity at first and second ends of the body, wherein the internal cavity is configured to receive therein the strap, and a pocket component having a body with sides that define therebetween an internal compartment, an opening to the internal compartment at a first end of the body, and first and second connection members configured to releasably couple the body to the first and second ends of the body of the sleeve component, respectively, such that the sleeve component forms a closed loop, wherein the internal compartment is configured to receive therein the firearm holster through the opening of the internal compartment while the firearm holster is secured to the strap and having the firearm therein.

In a first implementation of the invention, a holster cover device is provided to enhance comfort of a firearm holster configured to secure therein a firearm and a strap coupled to the firearm holster that is configured to secure the firearm holster to a user. The holster cover device comprises a sleeve component having an elongated body, an internal cavity extending through the body, and a pair of openings to the internal cavity at first and second ends of the body, wherein the internal cavity is configured to receive therein the strap, and a pocket component having a body with sides that define therebetween an internal compartment, an opening to the internal compartment at a first end of the body, and first and second connection members configured to releasably couple the body to the first and second ends of the body of the sleeve component, respectively, such that the sleeve component forms a closed loop, wherein the internal compartment is configured to receive therein the firearm holster through the opening of the internal compartment while the firearm holster is secured to the strap and having the firearm therein. The sleeve component and the pocket component in combination are configured to entirely cover portions of the strap and the firearm holster that would otherwise contact skin of the user while the strap and the firearm holster are secured to the user and thereby function as a barrier between the strap and the firearm holster and the user.

In a second aspect, the pocket component may include a first portion configured to be aligned with the first end of the sleeve component when the first connection is secured thereto, a second portion configured to be aligned with the second end of the sleeve component when the second connection is secured thereto, and a third portion between the first and second portions that includes the internal compartment and the opening thereto, wherein the first and second portions both include sleeve members having internal cavities with openings at ends thereof, wherein the internal cavities of the first and second portions are configured to receive portions of the strap.

In another aspect, the sleeve component may include elongated hook and loop fasteners at the first and second ends thereof that are configured to be received within openings of the first and second portions of the pocket component, respectively, the first and second connectors of the pocket component includes hook and loop fasteners secured to the third portion of the pocket component between the first and second components thereof, and the hook and loop fasteners of the sleeve component and the hook and loop fasteners of the pocket component are configured to mate to secure the pocket component to the sleeve component.

In another aspect, the third portion of the pocket component may include an inner side, an outer side, and intermediate sides coupling the inner side and the outer side, wherein distal edges of the inner side, the outer side, and the intermediate sides define the opening to the internal compartment of the body, wherein the distal edge of the inner side extends between the first and second portions, wherein the distal edge of the outer side is offset from the distal edge of the inner side in a direction toward a second end of the pocket component.

In another aspect, the distal edge of the outer side of the pocket component may define a U-shaped aperture adjacent the opening of the internal compartment.

In another aspect, the pocket component or the sleeve component may be configured such that the opening at the first end of the sleeve component and the opening at the first portion of the pocket component are spaced apart to provide an open region therebetween configured to provide access to a strap buckle of the strap when the strap is located within the internal cavities of the sleeve component and the first portion of the pocket component.

In another aspect, the holster cover device may include a shield component having a body and one or more connection members configured to releasably couple body of the shield component to the body of the pocket component such that the body of the shield component extends in a direction away from the opening of the internal compartment of the pocket component.

In another aspect, the body of the shield component may be configured to be located adjacent portions of the firearm exposed from the firearm holster while the firearm holster and the firearm are located in the internal compartment of the pocket component and the shield component is secured to the pocket component.

In another aspect, the one or more connection members of the shield component may include elongated hook and loop fasteners, wherein the hook and loop fasteners of the shield component and the hook and loop fasteners of the sleeve component are configured to simultaneously mate with the hook and loop fasteners of the pocket component.

In another aspect, the internal cavities of the first and second portions of the pocket component may be configured to receive portions of an elongated faceplate of a holster concealment chassis secured to the firearm holster.

In another aspect, the pocket component may include an additional hole configured to allow a leg leash coupled to the firearm holster to exit the internal compartment.

In another aspect, a method of using the holster cover device described above may include coupling the first and second connection members of the pocket component to the first and second ends of the sleeve component, respectively, such that the sleeve component forms a closed loop, providing the strap with the firearm holster secured thereto and the firearm secured within the firearm holster, inserting a first end of the strap into the opening of the second end of the sleeve component, threading the strap through the internal cavity of the sleeve component, and pulling the first end of the strap out of the opening of the first end of the sleeve component, inserting firearm holster with the firearm therein into the internal compartment of the pocket component, and securing the first and second ends of the strap to each other.

In another aspect, the method may include threading portions of the strap though internal cavities of the first and second portions of the pocket component.

In another aspect, the first and second connection members of the pocket component may be coupled to the first and second ends of the sleeve component, respectively, by threading the hook and loop fasteners at the first and second ends of the sleeve component into and through the internal cavities of the first and second portions of the pocket component, respectively, and mating the hook and loop fasteners of the sleeve component and the hook and loop fasteners of the pocket component.

In another aspect, the method may include locating a buckle of the strap within the open region between the opening at the first end of the sleeve component and the opening at the first portion of the pocket component.

In another aspect, the method may include coupling the connection member(s) of the shield component with the pocket component such that the body of the shield component extends in a direction away from the opening of the internal compartment of the pocket component.

In another aspect, the method may include locating the body of the shield component adjacent to portions of the firearm exposed from the firearm holster.

In another aspect, coupling the connection member(s) of the shield component with the pocket component may include simultaneously mating the hook and loop fasteners of the shield component and the hook and loop fasteners of the sleeve component with the hook and loop fasteners of the pocket component.

In another aspect, the method may include locating the elongated faceplate of the holster concealment chassis within the internal cavities of the first and second portions of the pocket component.

In another aspect, the holster concealment chassis may be a component of a firearm holster accessory sold under the brand name Enigma commercially available from PHLster LLC.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a convenient and economical holster cover device 100 that is capable of covering a belt, harness, or strap 140 having a firearm holster 144 secured thereto and a firearm 146 in the firearm holster 144 in a manner that promotes comfort of the user by avoiding contact between the user and surfaces of the strap 140, the firearm holster 144, and, optionally, the firearm 146. Notably, the holster cover device 100 may be used in a manner wherein the holster cover device 100 and its components are entirely separate from the strap 140, the firearm holster 144, and the firearm 146 while covering the same, and further may be independent of other items such as articles of clothing. In certain embodiments, the holster cover device 100 may be configured to be in direct contact with a user's skin while worn by the user, optionally under articles of clothing worn by the user, and may be entirely independent of such articles of clothing. As a specific example, the holster cover device 100 does not need to be used in combination with belt loops on a pair of pants.

Figure 1:
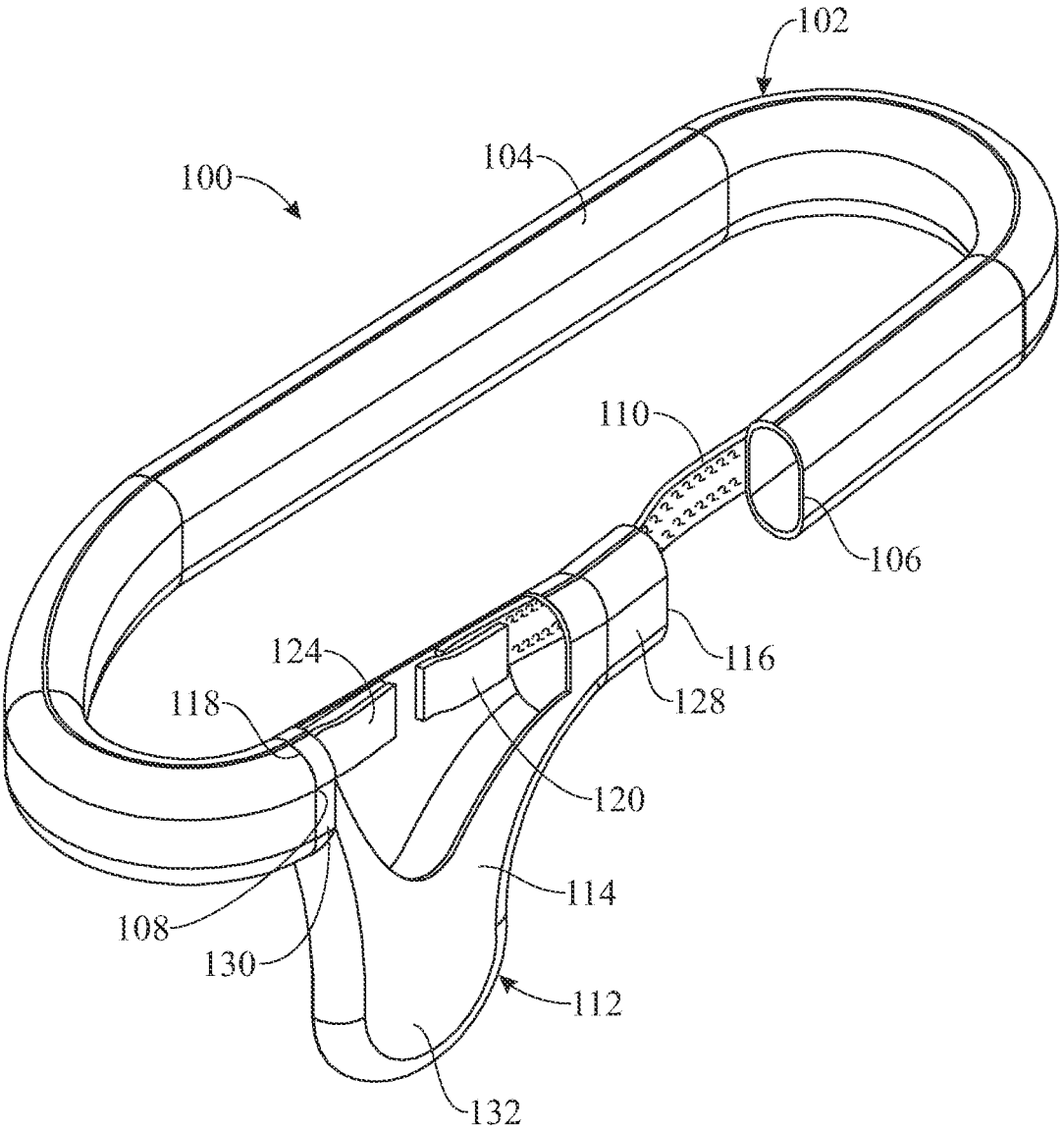
FIG. 1 presents a perspective view of a holster cover device in accordance with a first embodiment of the present invention.
Figure 2:
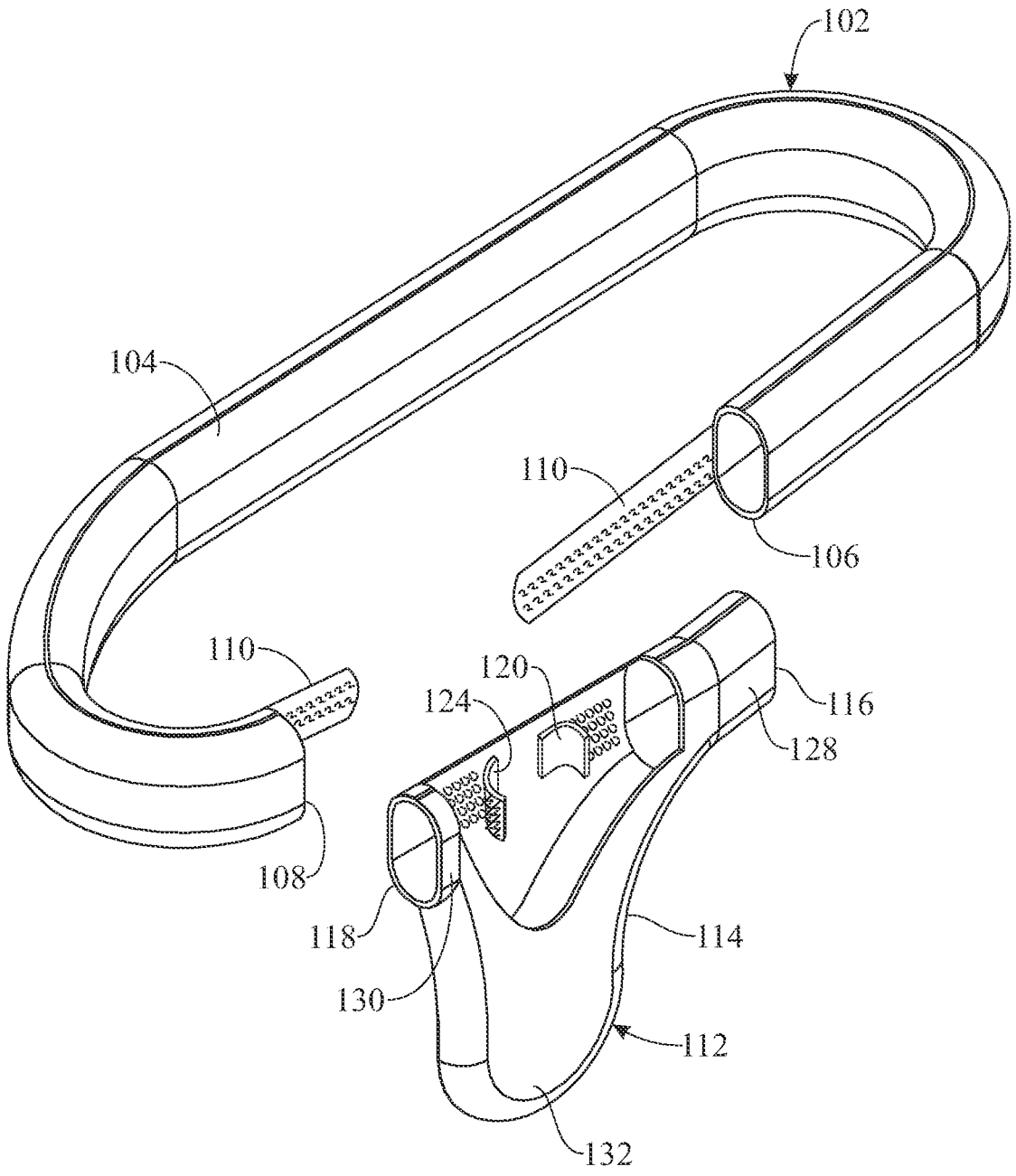
FIG. 2 presents a perspective view of the holster cover device of FIG. 1 with a sleeve component and a pocket component thereof coupled from one another.
Figure 3:
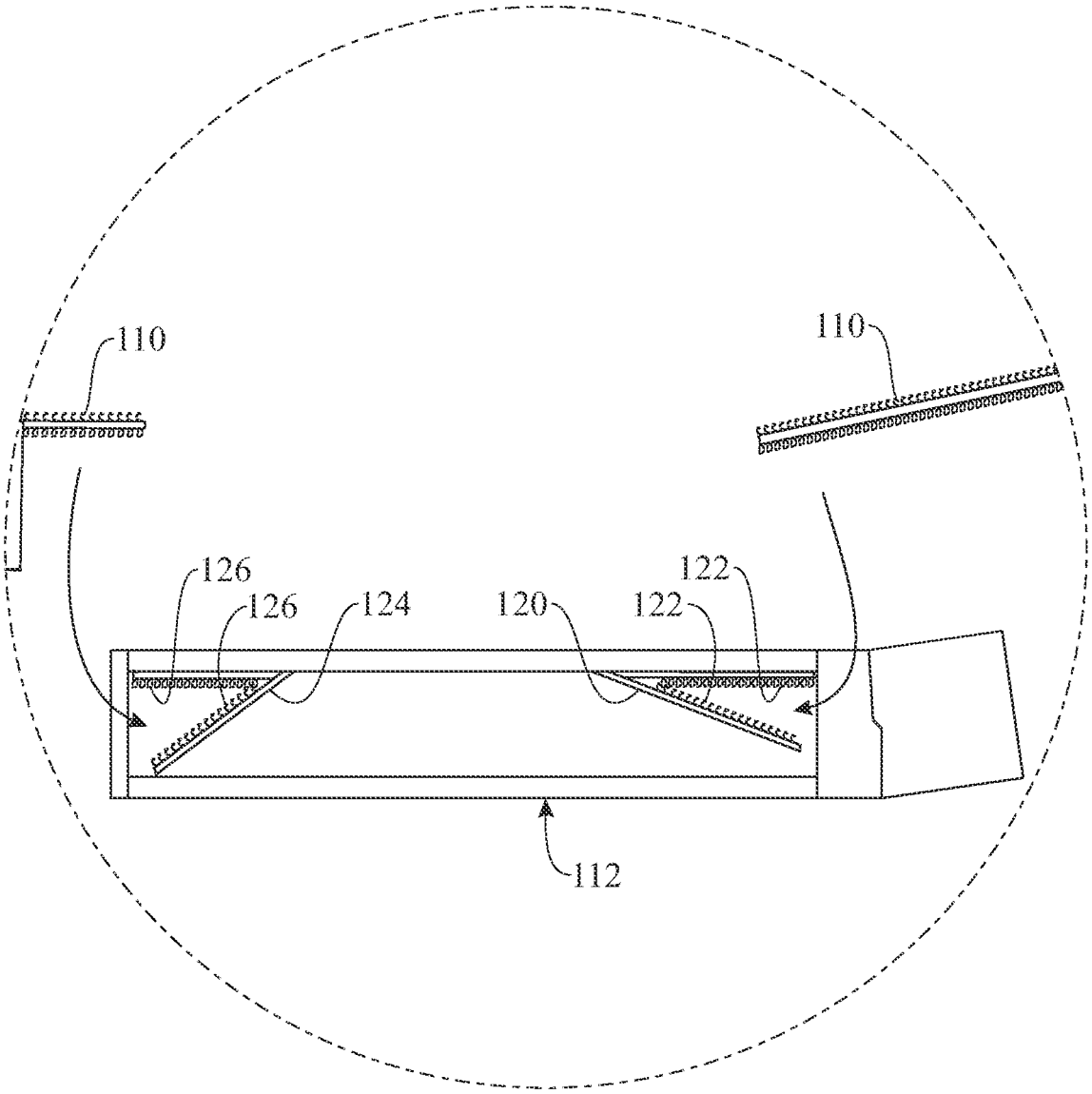
FIG. 3 presents an isolated top view of connection members of the pocket component of the holster cover device of FIG. 1 and illustrates a nonlimiting method of coupling the connections members to fasteners of the sleeve component.
Figure 4:
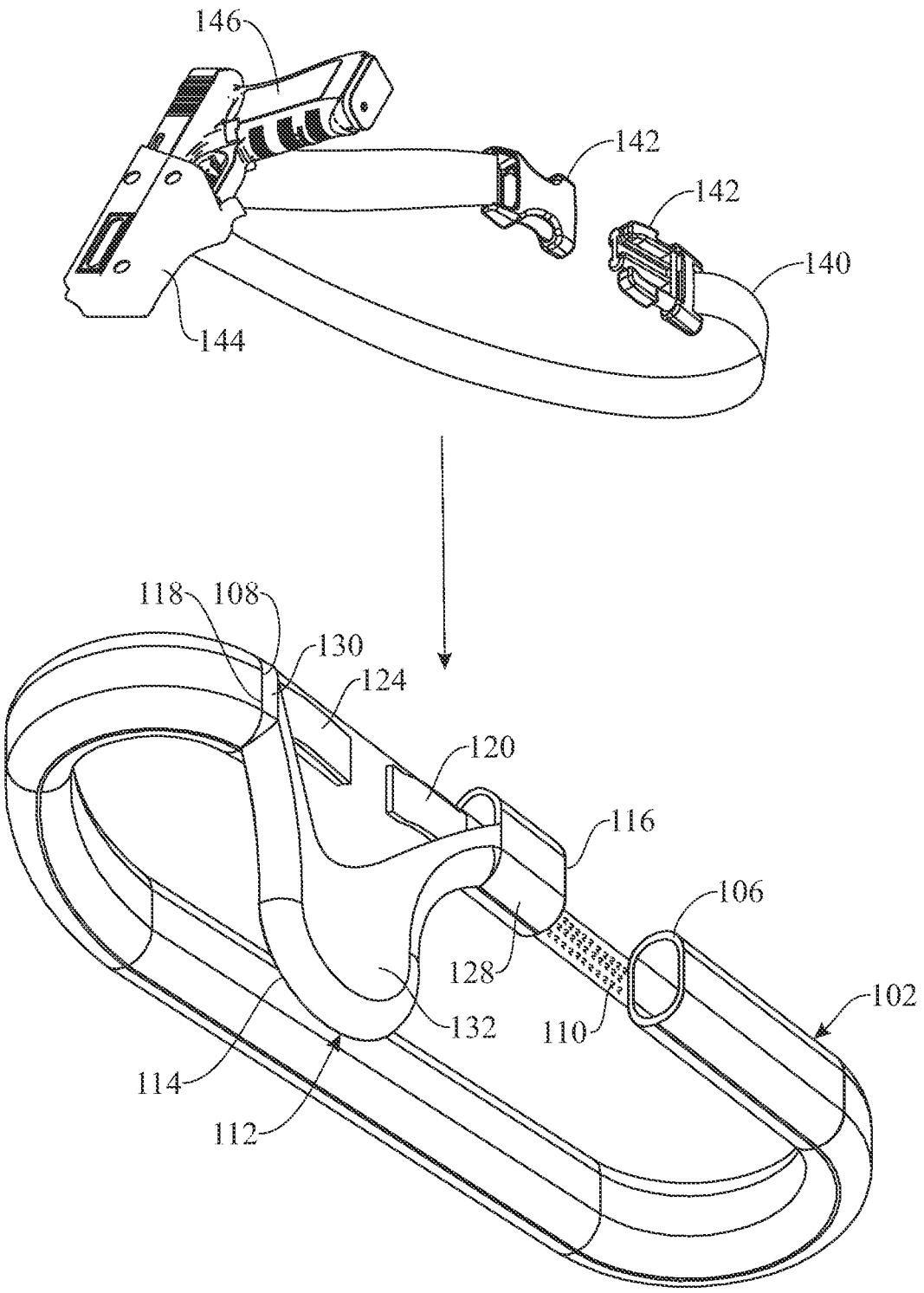
FIG. 4 presents a perspective view that illustrates a nonlimiting method of inserting a strap, a firearm holster, and a firearm into the holster cover device of FIG. 1.
Figure 5:
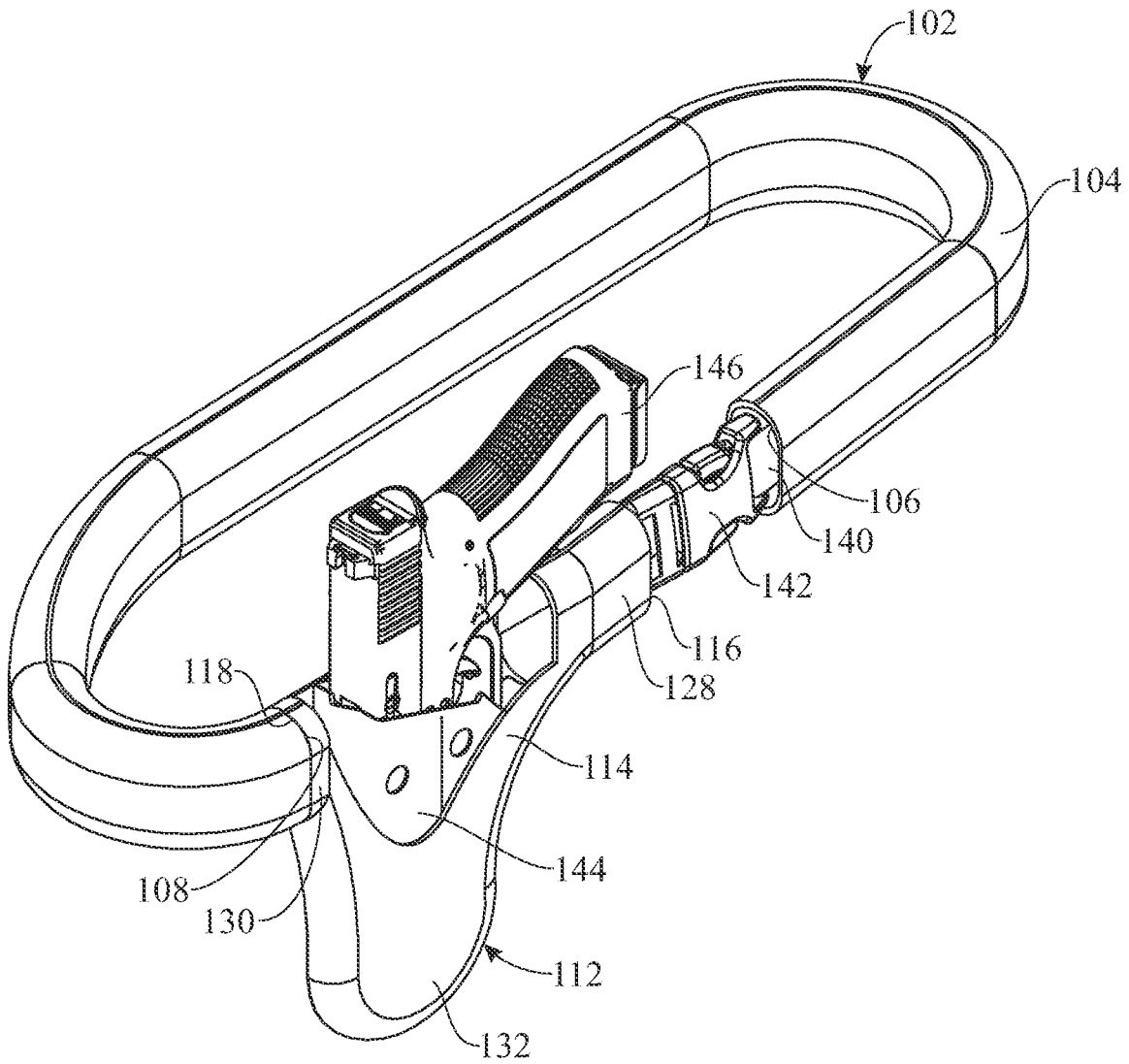
FIG. 5 presents a perspective of the holster cover device of FIG. 1 covering the strap, the firearm holster, and the firearm of FIG. 4.
Figure 6:
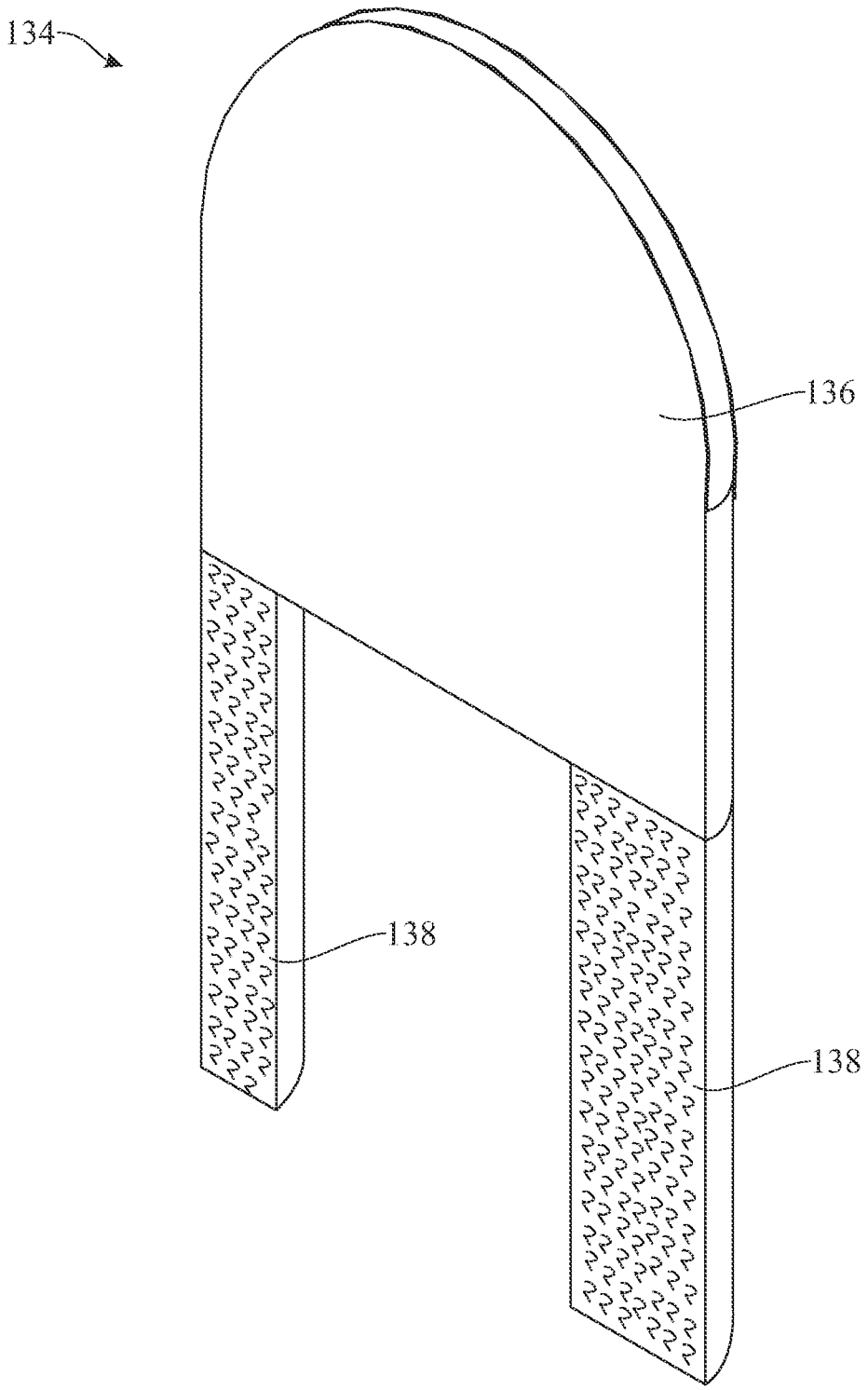
FIG. 6 presents a perspective view of a shield component that may be secured to the holster cover device of FIG. 1.
Figure 7:
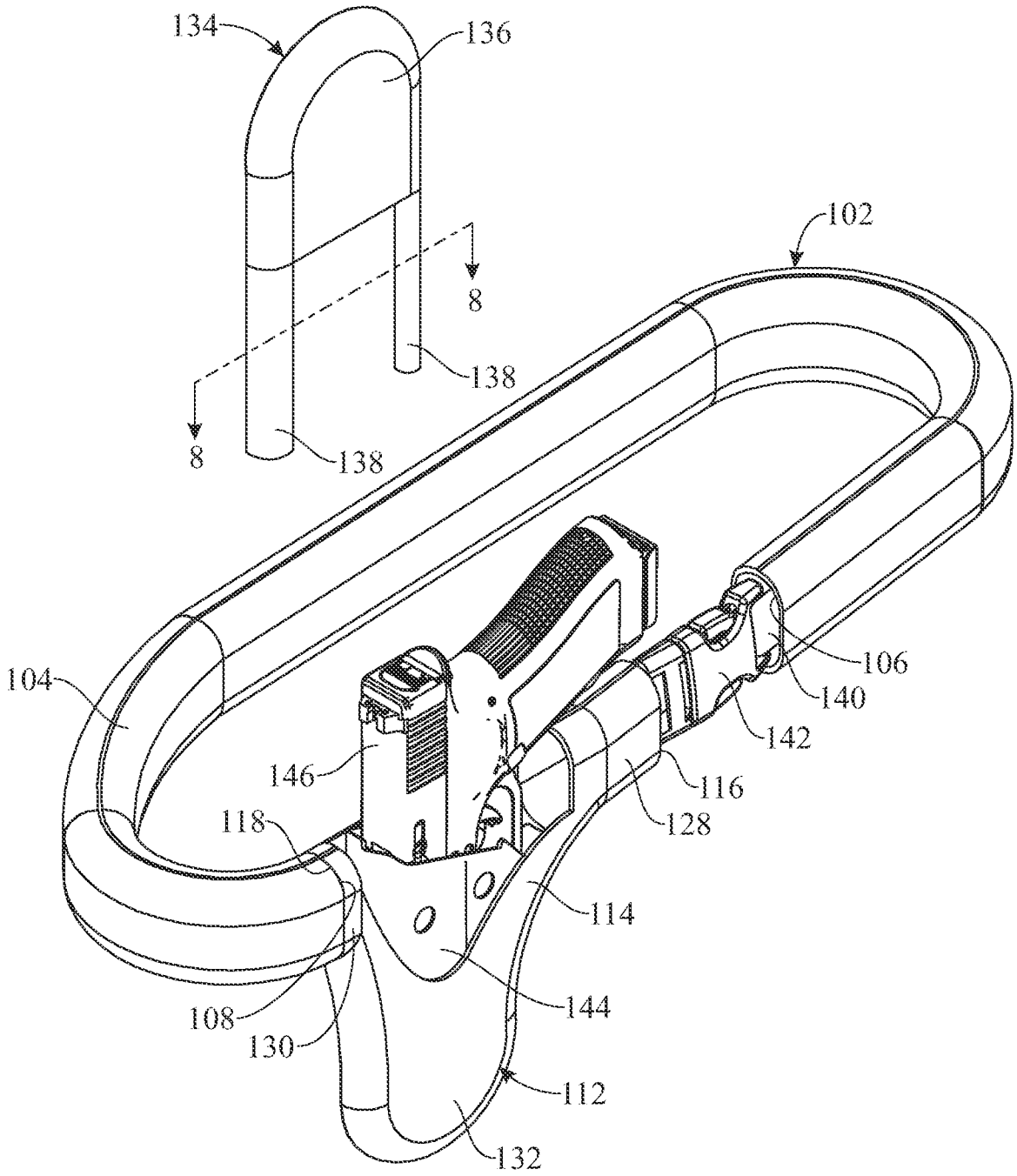
FIG. 7 presents a perspective view that illustrates a nonlimiting method of coupling the shield component of FIG. 6 to the holster cover device of FIG. 1.

Referring initially to FIGS. 1 through 5, the holster cover device 100 includes at least a sleeve component 102 and a pocket component 112. The sleeve component 102 includes an elongated body 104, an internal cavity extending through the body 104, and a pair of openings to the internal cavity at first and second ends 106 and 108 of the body 104. The pocket component 112 includes a body 114 with sides that define therebetween an internal compartment, an opening to the internal compartment of the body 114, and first and second connection members 120 and 124 configured to releasably couple first and second ends 116 and 118 of the body 114 to the first and second ends 106 and 108 of the body 104 of the sleeve component 102, respectively, such that the sleeve component 102 forms a closed loop (FIG. 1). The internal cavity of the sleeve component 102 is configured to receive the strap 140 therethrough and the internal compartment of the pocket component 112 is configured to receive therein the firearm holster 144 through the opening thereof while the firearm holster 144 is secured to the strap 140 and has the firearm 146 secured therein (FIGS. 4 and 5).

The pocket component 112 may include a first portion 128 configured to be aligned with the first end 106 of the sleeve component 102 when the first connection member 120 is secured thereto, a second portion 130 configured to be aligned with the second end 108 of the sleeve component 102 when the second connection member 124 is secured thereto, and a third portion 132 between the first and second portions 128 and 130 that includes the internal compartment and the opening thereto. The first and second portions 128 and 130 both include sleeve members that have internal cavities with openings at ends thereof. The internal cavities of the first and second portions 128 and 130 are configured to receive portions of the strap 140 therethrough, similar to the internal cavity of the sleeve component 102.

The sleeve component 102 may include elongated hook and loop fasteners at the first and second ends 106 and 108 thereof that are configured to be received within openings of the first and second portions 128 and 130 of the pocket component 112, respectively (FIG. 2). The first and second connection members 120 and 124 of the pocket component 112 include hook and loop fasteners secured to the third portion 132 of the pocket component 112 between the first and second portions 128 and 130 thereof. The hook and loop fasteners of the sleeve component 102 and the hook and loop fasteners of the pocket component 112 are configured to mate to secure the pocket component 112 to the sleeve component 102 (FIG. 3).

The third portion 132 of the pocket component 112 may include an inner side, an outer side, and intermediate sides coupling the inner side and the outer side. Distal edges of the inner side, the outer side, and the intermediate sides define the opening to the internal compartment of the body 114. The distal edge of the inner side extends between the first and second portions 128 and 130. However, the distal edge of the outer side is offset from the distal edge of the inner side in a direction from the opening of the internal compartment toward a base of the internal compartment of the pocket component 112 opposite the opening. In this example, the offset of the distal edge of the outer side of the pocket component 112 defines a U-shaped aperture adjacent the opening of the internal compartment. As presented in FIG. 5, this U-shaped aperture promotes additional access to the firearm holster 144 and/or the firearm 146 therein and may promote insertion and removal of the firearm holster 144 to and from the internal compartment of the pocket component 112.

The pocket component 112 and/or the sleeve component 102 may be configured such that the opening at the first end 106 of the sleeve component 102 and the opening at the first portion 128 of the pocket component 112 are spaced apart to provide an open region therebetween configured to provide access to a strap buckle 142 of the strap 140 when the strap 140 is located within the internal cavities of the sleeve component 102 and the first portion 128 of the pocket component 112 (FIGS. 1, 4, and 5). In this example, the hook and loop fastener of the first end 106 of the sleeve component 102 has a length sufficient to couple with the first connection member 120 of the pocket component 112 while providing the open region between the sleeve component 102 and the pocket component 112. This open region may promote ease of coupling and/or decoupling the strap buckle 142 and therefore securing and/or releasing the strap 140 with or without the holster cover device 100 from around the user.

Figure 8:
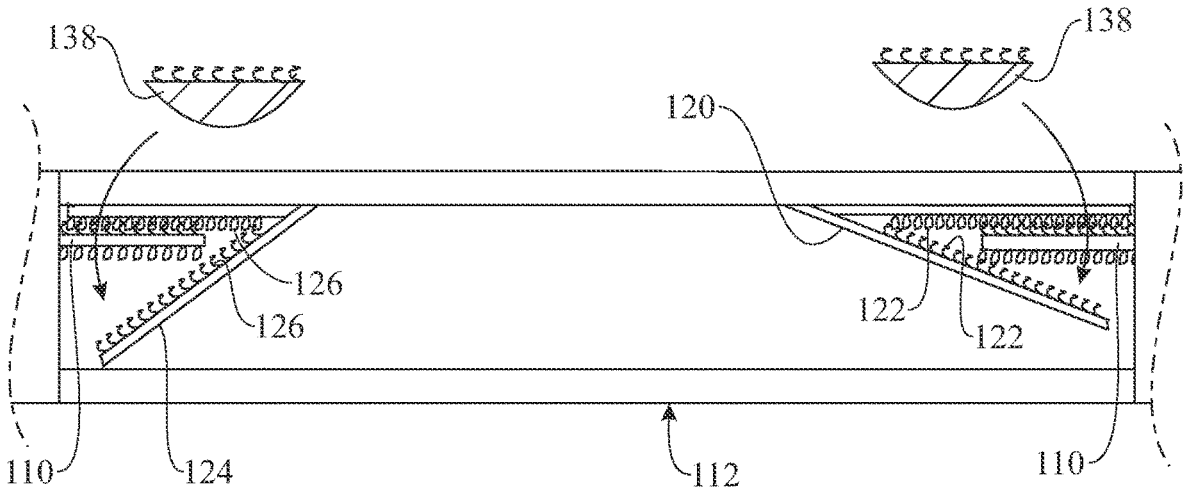
FIG. 8 presents an isolated top view of the connection members of the pocket component of the holster cover device of FIG. 1 and illustrates a nonlimiting method of simultaneously coupling the connections members to fasteners of the sleeve component and fasteners of the shield component.
Figure 9:
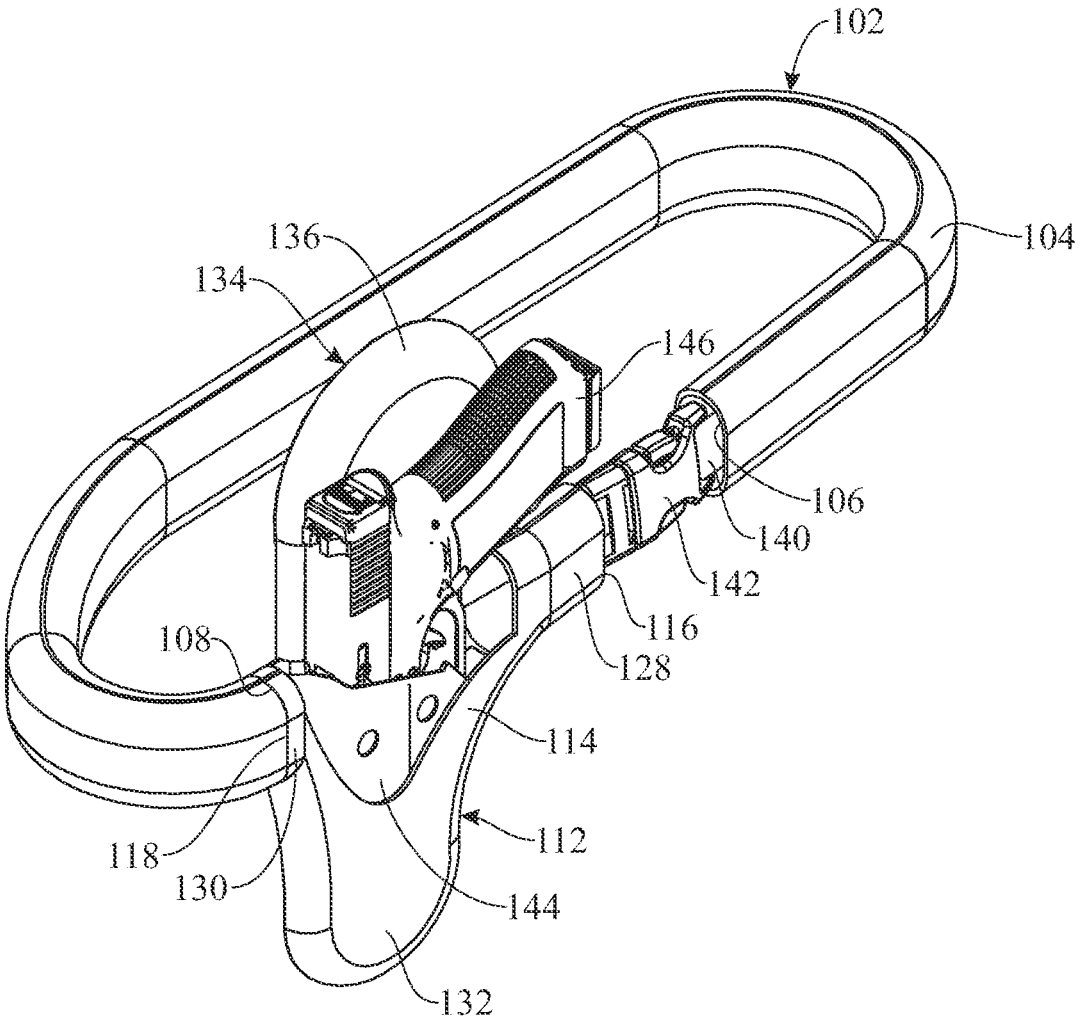
FIG. 9 presents a perspective of the holster cover device of FIG. 1 covering the strap, the firearm holster, and the firearm of FIG. 4 with the shield component coupled to the pocket component.
Figure 10:
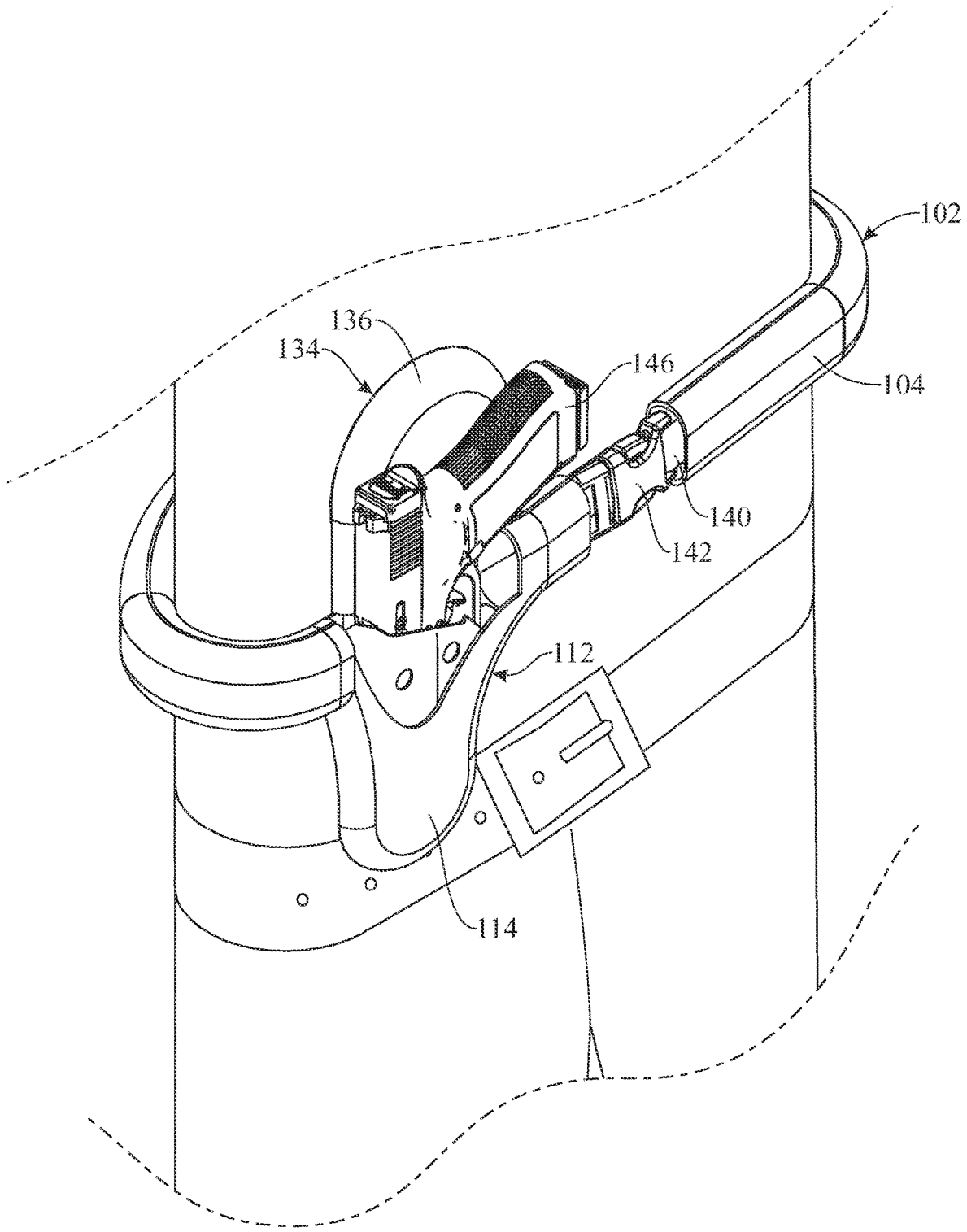
FIG. 10 presents a perspective view that illustrates a nonlimiting method of securing the holster cover device of FIG. 1 with the shield component coupled thereto and the strap, the firearm holster, and the firearm of FIG. 4 covered thereby to a user in manner that reduces the likelihood of contact between the user and the strap, firearm holster, and the firearm.

Referring now to FIGS. 6 through 10, the holster cover device 100 may optionally include a shield component 134 having a body 136 and one or more connection members 138 configured to releasably couple body 136 of the shield component 134 to the body 114 of the pocket component 112 such that the body 136 of the shield component 134 extends in a direction away from the opening of the internal compartment of the pocket component 112. The body 136 of the shield component 134 is configured to be located adjacent portions of the firearm 146 exposed from the firearm holster 144 while the firearm holster 144 and the firearm 146 are located in the internal compartment of the pocket component 112 and the shield component 134 is secured to the pocket component 112. In particular, the shield component 134 preferably acts as a barrier between the user and the portions of the exposed portions of the firearm 146 (FIG. 10). The connection members 138 of the shield component 134 may include elongated hook and loop fasteners. The hook and loop fasteners of the shield component 134 and the hook and loop fasteners of the sleeve component 102 may be configured to simultaneously mate with the hook and loop fasteners of the pocket component 112 (FIG. 8). In certain embodiments, the hook and loop fasteners of the shield component 134 may include rigid or semi-rigid frame components configured to support the body 136 of the shield component 134 in the upright position relative to the opening of the pocket component 112. As presented in FIG. 10, the holster cover device 100 may be used independently of other securing devices, such as the belt shown in FIG. 10 and any belt loops (not shown) through which the belt is threaded.

The holster cover device 100 may be configured to accommodate other accessories in addition to the firearm 146 and the firearm holster 144. For example, the components of the sleeve component 102 and/or the pocket component 112 may be configured to accommodate a knife sheath with a knife therein, a flashlight, additional firearm magazines, pouches, speed loaders, etc., and/or the firearm 146 with accessories secured thereto, such as a flashlight, laser sight, etc. In certain embodiments, such accessories may be accommodated by releasably coupling one or more additional components between the sleeve component 102 and the pocket component 112 without the necessity of modifying the sleeve component 102 or the pocket component 112. For example, a knife sheath may be provided with connection members configured to mate with the hook and loop fasteners of the second end 108 of the sleeve component 102 and the second connection member 124 of the pocket component 112 and thereby be secured between the second end 108 of the sleeve component 102 and the second end 118 of the pocket component 112. If the firearm holster 144 that includes a leg leash for stabilizing the firearm holster 144 relative to the user's leg, the pocket component 112 may include one or more additional holes or slots configured to allow the leg leash to exit the internal compartment, for example, at the base thereof.

In certain embodiments, the holster cover device 100 may be configured to accommodate a holster concealment chassis and components thereof. For example, the internal cavities of the first and second portions 128 and 130 of the pocket component 112 may be configured to receive portions of an elongated faceplate of the holster concealment chassis secured to the firearm holster 144. A specific but nonlimiting example of such holster concealment chassis is commercially available under the brand name Enigma™ from PHLster LLC.

The holster cover device 100 may be assembled and secured to a user by coupling the first and second connection members 120 and 124 of the pocket component 112 to the first and second ends 106 and 108 of the sleeve component 102, respectively, such that the sleeve component 102 forms a closed loop. In the presented example, the first and second connection members 120 and 124 of the pocket component 112 may be coupled to the first and second ends 106 and 108 of the sleeve component 102, respectively, by threading the hook and loop fasteners at the first and second ends 106 and 108 of the sleeve component 102 the internal cavities of the first and second portions 128 and 130 of the pocket component 112, respectively, and mating the hook and loop fasteners of the sleeve component 102 and the hook and loop fasteners of the pocket component 112.

The strap 140 may be provided with the firearm holster 144 secured thereto and, optionally, the firearm 146 secured within the firearm holster 144. A first end of the strap 140 may be inserted into the opening of the second end of the sleeve component 102, threaded through the internal cavity of the sleeve component 102, and removed from the opening of the first end 106 of the sleeve component 102. The firearm holster 144 may be inserted with the firearm 146 therein into the internal compartment of the pocket component 112. Once positioned on the user, for example, with the sleeve component 102 and strap 140 therein around the user's waist, the first and second ends of the strap 140 may be secured to each other with the strap buckle 142. If the pocket component 112 includes the sleeve members, portions of the strap 140 may be threaded though the internal cavities of the first and second portions 128 and 130 of the pocket component 112 prior to fastening the strap 140. Preferably, the strap buckle 142 is located within the open region between the opening at the first end of the sleeve component 102 and the opening at the first portion 128 of the pocket component 112.

For embodiments that include the shield component 134, the connection member(s) of the shield component 134 may be coupled with the pocket component 112 such that the body 136 of the shield component 134 extends in a direction away from the opening of the internal compartment of the pocket component 112. Preferably, the body 136 of the shield component 134 is located adjacent to some or all of the exposed portions of the firearm 146 adjacent the user. In the presented example, the hook and loop fasteners of the shield component 134 and the hook and loop fasteners of the sleeve component 102 may be simultaneously mated with the hook and loop fasteners of the pocket component 112.

If a holster concealment chassis is used that includes an elongated faceplate, portions of the faceplate may be inserted within the internal cavities of the first and second portions 128 and 130 of the pocket component 112.

In certain embodiments, the strap 140 with the firearm holster 144 and firearm 146 thereon may be secured to and within the holster cover device 100, and then the entire assembly may be wrapped around and secured to, for example, a user's waist by coupling the strap buckle 142 and the connection member 110 at the first end of the sleeve component 102. In this manner, the entire assembly may be repeatedly coupled and removed from the user without having to reassemble the strap 140, the firearm holster 144, and the firearm 146 with the holster cover device 100.

The holster cover device 100 and its components may be formed of various materials. In certain embodiments, the sleeve component 102 and the pocket component 112 may include various natural or synthetic, woven or unwoven fabric materials such as four-way stretch, woven nylon fabrics available under the tradenames 520E Durastretch™ fabric from Tweave, LLC, and under the tradenames SAM1® fabric and SAM2® fabric from MMI Textiles, Inc., and natural cotton. The hook and loop fasteners, especially the fasteners for the shield component 134 may be a reinforced or hardened hook and loop fastener that has a relatively high stiffness relative to other types of hook and loop fasteners. For example, the hook and loop fasteners of the shield component 134 may be formed of stiff strips of hook and loop panels available under the tradename Velcro® One-Wrap®. The body 136 of the shield component 134 may include a layer of fabric fixed to a rigid or semi-rigid frame or substrate.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A holster cover device for securing a firearm therein, the holster cover device comprising:

a sleeve component that includes opposing open ends and an internal passageway for receiving a fastener strap therein for securing the holster cover device onto a user;

a pocket component having a body defining an internal compartment for receiving a firearm holster therein, and a pair of openings on opposite sides of the body that are selectively alignable with the open ends of the sleeve, respectively, wherein the sleeve component and the pocket component in combination are configured to prevent skin contact with the firearm holster and the fastener strap when worn by the user; and an elongated hook and loop fasteners included with the sleeve component, where the elongated hook and loop fasteners selectively couple the pocket component to the sleeve component.

2. The holster cover device of claim 1, wherein the openings of the sleeve component and the openings of the pocket component are big enough to allow passage of a strap buckle therethrough.

3. The holster cover device of claim 1, further comprises a shield component attachable to an interior wall portion of the internal compartment of the pocket component.

4. The holster cover device of claim 3, wherein the shield component includes a shield body and one or more connection members extending outwardly from the shield body for removably attaching the shield component to the pocket component.

5. The holster cover device of claim 4, wherein the shield body when attached to the pocket component extends upwardly from therefrom.

6. The holster cover device of claim 1, wherein the sleeve component is made out of pliable material that easily conforms to the user's midsection.

7. The holster cover device of claim 1, wherein the pocket component maintains the firearm holster in a holstered position during the unholstering of a firearm.

8. A holster cover device for securing a firearm therein, the holster device comprising:

a sleeve component that includes opposing open ends and an internal passageway for receiving a fastener strap therein for securing the holster cover device onto a user; and a pocket component having a body defining an internal compartment for receiving a firearm holster therein, and a pair of openings on opposite sides of the body that are selectively alignable with the open ends of the sleeve, respectively, wherein the sleeve component and the pocket component in combination are configured to prevent skin contact with the firearm holster and the fastener strap when worn by the user; and wherein the sleeve component and the pocket component each include hook and loop fasteners that are configured to engage one another to selectively mate the pocket component to the sleeve component.

9. A holster cover device for securing a firearm therein, the holster cover device comprising:

a sleeve component having an elongated body, an internal cavity extending through the body, and a pair of openings to the internal cavity at first and second ends of the body, wherein the internal cavity is configured to receive therein a strap; and a pocket component having a body with sides that define therebetween an internal compartment, an opening to the internal cavity at a first end of the body, first and second connection members configured to releasably couple the body to the first and second ends of the body of the sleeve component, respectively, such that the sleeve component forms a closed loop, wherein the internal compartment is configured to receive therein the firearm holster through an opening of the internal compartment while the firearm holster is secured to the strap and having the firearm therein;

wherein the sleeve component and the pocket component in combination are configured to entirely cover portions of the strap and the firearm holster that would otherwise contact skin of the user while the strap and the firearm holster are secured to the user and thereby function as a barrier between the strap and the firearm holster and the user.

10. The holster cover device of claim 9, wherein the pocket component includes a first portion configured to be aligned with the first end of the sleeve component when the first connection member is secured thereto, a second portion configured to be aligned with the second end of the sleeve component when the second connection member is secured thereto, and a third portion between the first and second portions that include the internal compartment and the opening thereto.

11. The holster cover device of claim 10, wherein the first and the second portions both include sleeve members having internal cavities with openings at ends thereof, and wherein the internal cavities of the first and second portions are configured to receive portions of the strap.

12. The holster cover device of claim 10, wherein the third portion of the pocket component includes an inner side, an outer side, and intermediate sides coupling the inner side and the outer side, wherein distal edges of the inner side, the outer side, and the intermediate sides define the opening to the internal compartment of the body, wherein the distal edge of the inner side extends between the first and second portions, and wherein the distal edge of the outer side is offset from the distal edge of the inner side in a direction toward a second end of the pocket component.

13. The holster cover device of claim 9, wherein the sleeve component includes elongated hook and loop fasteners at the first and second ends thereof that are configured to be received within openings of the first and second portions of the pocket component, respectively, the first and second connectors of the pocket component include hook and loop fasteners secured to the third portion of the pocket component between the first and second components thereof, and the hook and loop fasteners of the sleeve component and the hook and loop fasteners of the pocket component are configured to mate to secure the pocket component to the sleeve component.

14. The holster cover device of claim 9, wherein a distal edge of an outer side of the pocket component defines a U-shaped aperture adjacent the opening of the internal compartment.

15. The holster cover device of claim 9, further comprises a shield component having a body and one or more connection members configured to releasably couple the body of the shield component to the body of the pocket component such that the body of the shield component extends in a direction away from the opening of the internal compartment of the pocket component.

16. The holster cover device of claim 15, wherein the one or more connection members of the shield component include elongated hook and loop fasteners, and the hook and loop fasteners of the shield component and the hook and loop fasteners of the sleeve component are configured to simultaneously mate with the hook and loop fasteners of the pocket component.

17. A method for using a holster cover device, including the steps of:

providing a holster cover device, comprising a sleeve component that includes opposing open ends and an internal passageway for receiving a fastener strap with a buckle therein for securing the holster cover device onto a user;

a pocket component having a body defining an internal compartment for receiving a firearm holster therein, and a pair of openings on opposite sides of the body that are selectively alignable with the open ends of the sleeve, respectively; and an elongated hook and loop fasteners within the sleeve component, where the elongated hook and loop fasteners selectively couple the pocket component to the sleeve component;

coupling the sleeve component to the pocket component to form a closeable loop;

passing the fastener strap through the closeable loop; and inserting a firearm holster into the internal compartment of the pocket component, wherein the sleeve component and the pocket component in combination are configured to prevent skin contact with the firearm holster and the fastener strap when worn by the user.

* * * * *